US011396090B2

(12) United States Patent
Lai

(10) Patent No.: US 11,396,090 B2
(45) Date of Patent: Jul. 26, 2022

(54) SCREW DEPTH ADJUSTER FOR DRIVING SCREW TO CERTAIN DEPTH AND METHOD FOR DRIVING SCREW TO CERTAIN DEPTH BY USING THE SAME

(71) Applicant: ROTE MATE INDUSTRY CO., LTD., Taichung (TW)

(72) Inventor: Ying-Tsung Lai, Taichung (TW)

(73) Assignee: ROTE MATE INDUSTRY CO., LTD., Taichung (TW)

( * ) Notice: Subject to any disclaimer, the term of this patent is extended or adjusted under 35 U.S.C. 154(b) by 232 days.

(21) Appl. No.: 16/777,897

(22) Filed: Jan. 31, 2020

(65) Prior Publication Data

US 2021/0237235 A1 Aug. 5, 2021

(51) Int. Cl.
*B25B 23/00* (2006.01)
*B25B 21/00* (2006.01)

(52) U.S. Cl.
CPC ..... *B25B 23/0064* (2013.01); *B25B 21/00* (2013.01)

(58) Field of Classification Search
CPC . B25B 23/0064; B25B 23/0071; B25B 21/00; B25B 23/00; B25B 23/02; B25B 23/12; B25B 23/101; B25B 23/10; B25B 23/005; B25B 15/007
See application file for complete search history.

(56) References Cited

U.S. PATENT DOCUMENTS 5,182,973 A * 2/1993 Martindell ..... B25B 23/0064 81/429
6,698,319 B2 * 3/2004 Huang ..... B25B 23/12 81/438
2006/0230887 A1 * 10/2006 Taguchi ..... B25B 23/0035 81/451
2007/0034060 A1 * 2/2007 McCracken ..... B25B 23/0064 81/429
2008/0289459 A1 * 11/2008 Yablon ..... B25B 23/0064 81/451
2009/0174157 A1 * 7/2009 Chang ..... B25B 23/12 279/9.1
2010/0224038 A1 * 9/2010 Evatt ..... B25B 15/001 81/429
2015/0122089 A1 * 5/2015 Rajotte ..... B25B 23/0035 81/429

* cited by examiner

*Primary Examiner* — Robert J Scruggs
(74) *Attorney, Agent, or Firm* — Raymond Chan

(57) ABSTRACT

A screw depth adjuster used for driving screws to the required depth is revealed. Users can control the depth of the screw being driven to workpiece/material by the screw depth adjuster. The screw depth adjuster includes a rod assembled with a control member, a driving member and a flared sleeve. The control member abutting against and assembled with the driving member is used for locking the driving member so that the driving member is unable to move. The flared sleeve is driven by the driving member mounted therein to to move forward or backward on the rod. Users determine the longitudinal movement of the driving member according to the depth of the screw required so that the screw will not be driven beyond the depth required in the workpiece. Thereby dents formed on the surface of the workpiece can be minimized.

2 Claims, 5 Drawing Sheets

SCREW DEPTH ADJUSTER FOR DRIVING SCREW TO CERTAIN DEPTH AND METHOD FOR DRIVING SCREW TO CERTAIN DEPTH BY USING THE SAME

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a screw depth adjuster, especially to a screw depth adjuster in which screws are positioned after being driven to the required depth from surfaces of workpiece/material for preventing damages on the surface of the workpiece/material and damages on the screw caused by being driven too much.

Description of Related Arts

Screw depth adjusters are well known to people skilled in the art, as revealed in US Pat. Pub. No. 20080289459, U.S. Pat. Nos. 5,235,327, 4,736,658, etc. Refer to US Pat. Pub. No. 20080289459, a screw/depth control driver device used for preventing the screw from driving beyond the depth required by users is revealed. The device has a free-spinning sleeve 17. In order to achieve the above purpose, a device is provided to set and hold the amount of return by the sleeve before the torque driving the screw is released preventing the screw from being over-driven. The device further includes a screw driving device 12, a depth control stop/setting nut 14 and a lock-retaining ring 16. The screw driving device 12 has a thread pattern to allow the depth control stop 14 to be moved forward or backward and held along the screw driving device 12 to control the depth of the screw being driven. The sleeve 17 can rotate freely on the screw driving device 12. The lock retaining ring 16 is unable to rotate when engaged over the depth control stop 14. While in use, the depth control stop is rotated on the screw driving device to be fixed at a selected longitudinal position of the device. Then the lock retaining ring 16 is slid back over the depth control stop 14. When the screw driving device is driven forward, the depth control stop comes to butt against the screw control sleeve so that the screw driving device cannot be driven forward any further and hence the screw cannot be driven forward any further. To use the device, the depth control stop 14, the lock retaining ring 16 and the sleeve 17 are moved in turn.

In order to set a desired depth of the screw, the depth control stop 14 is first rotated clockwise/anti-clockwise. Then the lock retaining ring 16 is slid back over the depth control stop 14. The sleeve 17 is then slid completely forward until a flared end is beyond. However, the position of the sleeve 17 during the driving is unable to learn in a real-time manner. Thus the depth control stop 14 has to be moved multiple times for adjustment. During each time of adjustment of the driving depth, the sleeve 17 needs to be moved first and then the lock retaining ring 16 is slid forward to disengage the depth control stop 14, hence the depth control stop 14 can rotate and move for adjustment. Users can't learn whether the position of the sleeve 17 is correct for the desired depth of the screw while adjusting the depth control stop. Therefore the device is inconvenient to use.

Moreover, the screw/depth control driver device further includes two longitudinally-oriented grooves 30 and the lock retaining ring 16 has two protrusions 27 on opposite sides that fit into the longitudinally-oriented grooves 30 correspondingly. The above design has significant shortcomings. The power tools available on the market now provide greater rotary torsion. The most common range of rotary torsion is 150-240 Newton-meter (Nm) and the revolutions per minute (RPM) is ranging from 3200 to 3600. When the sleeve 17 is in contact with the workpiece, the IPM (impacts per minute) is 3500~4000. The impact force acted on the sleeve 17 is returned to the depth control stop 14 so that the protrusions 27 and the longitudinally-oriented grooves 30 hit each other and cause deformation. The protrusions 27 of the depth control stop 14 are unable to move smoothly in the longitudinally-oriented grooves 30 once being deformed, and even easily locked in the grooves 30. Thereby the depth control stop 14 can't be moved for adjustment.

Furthermore, the depth control stop 14 contains detent balls 28 each of which fit over a spring 15. Thus the dent balls 28 can be elastically protruding from or popped in the depth control stop 14. The lock retaining ring 16 has a groove on the inside designed 25 to allow the dent balls 28 set into the depth control drop 14 to be engaged into the lock retaining ring 16 to hold the lock retaining ring 16 into place over the depth control stop 14. During adjustment, the depth control drop 14 needs to be rotated a circle until the dent balls 28 being mounted into the grove 25 correspondingly. There is a limit on the rotation of the depth control drop 14—at least half a circle as one scale. Thereby the screw/depth control driver device 10 doesn't have fine-adjustment function.

Thus there is room for improvement and there is need to provide a novel screw depth adjuster that solves the problems mentioned above.

SUMMARY OF THE PRESENT INVENTION

Therefore it is a primary object of the present invention to provide a screw depth adjuster which not only allows users to learn the depth of the control member/sleeve going to be adjusted in a real-time manner but also avoids damages caused by vibrations generated during the adjustment.

It is another object of the present invention to provide a screw depth adjuster which provides fine adjustment of the depth of screws so that the screw can be driven to the position required properly.

In order to achieve the above objects, a screw depth adjuster used for allowing users to control the depth of the screw being driven into the workpiece according to the present invention includes a rod assembled with a control member, a driving member and a flared sleeve. The rod consists of a first portion and a second portion formed by extension of the first portion. The first portion is a polygonal rod used for connection with power tools while the second portion is a threaded rod with an assembly portion extended from the rear end. A first plane and a second plane are disposed on two sides of the threaded rod longitudinally and arranged in parallel to each other. The control member consists of a push portion and a polygonal stopper extended from the push portion. Thereby the control member can be pushed and moved slidably axially on the threaded rod. The driving member is provided with an adjustment portion and a sleeve portion extended from the adjustment portion. A polygonal second passage is disposed on the adjustment portion and a threaded third passage is formed by extension of the second passage to the sleeve portion. The shape of the polygonal second passage matches the shape of the polygonal stopper of the control member. The flared sleeve can be pushed by the driving member to be moved on the rod while the control member is used to lock the driving member so that the driving member can't be rotated and moved on the rod any further. The control member is for positioning the driving member. The driving member used for pushing the flared sleeve can be moved forward/backward on the rod and positioned at the rod for adjustment of the depth of the screw. The flared sleeve is idling once abutting against the surface of the workpiece/material so that the screw will not be driven beyond the depth required in the workpiece.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
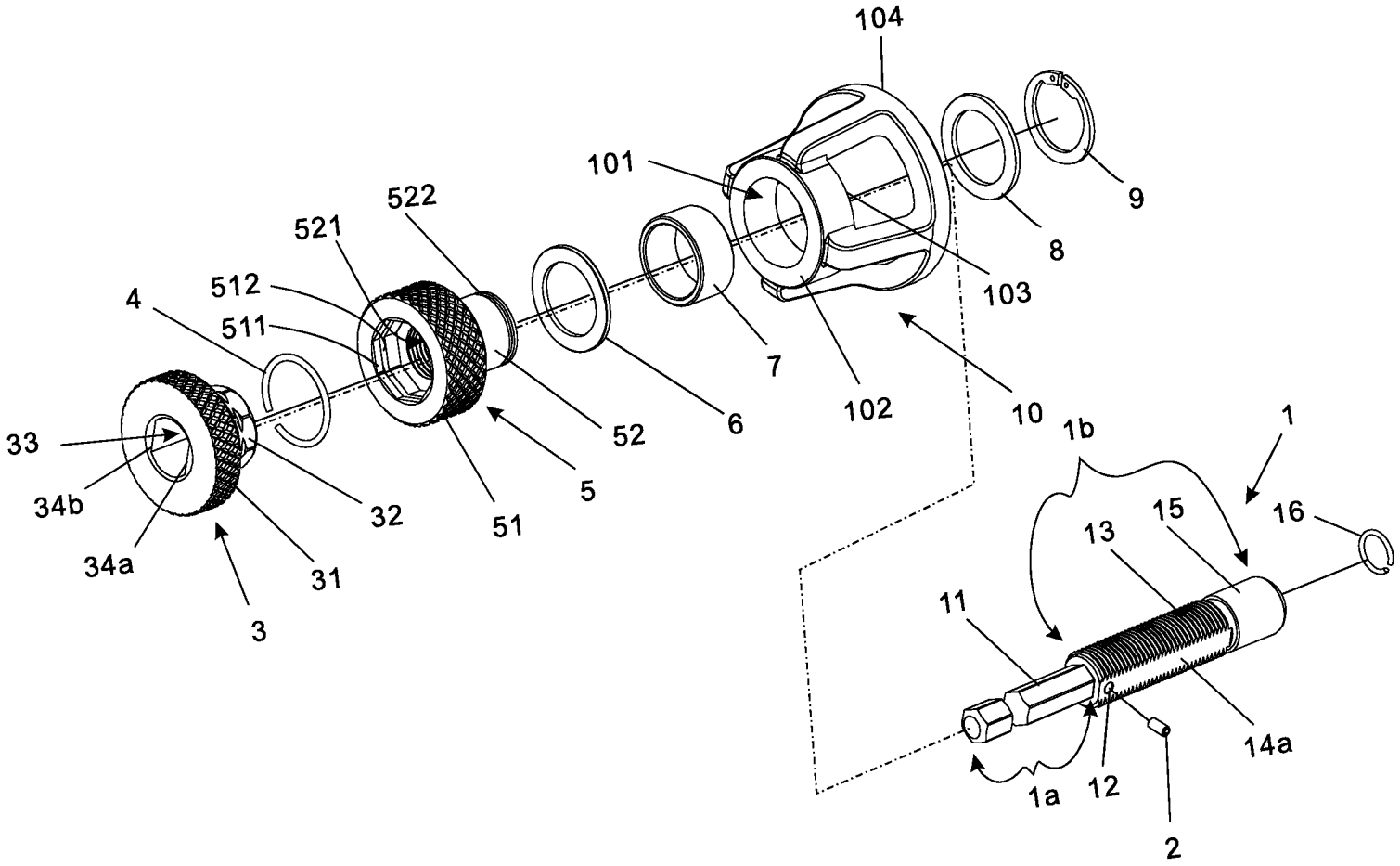
FIG. 1 is an explosive view of an embodiment according to the present invention.
Figure 2:
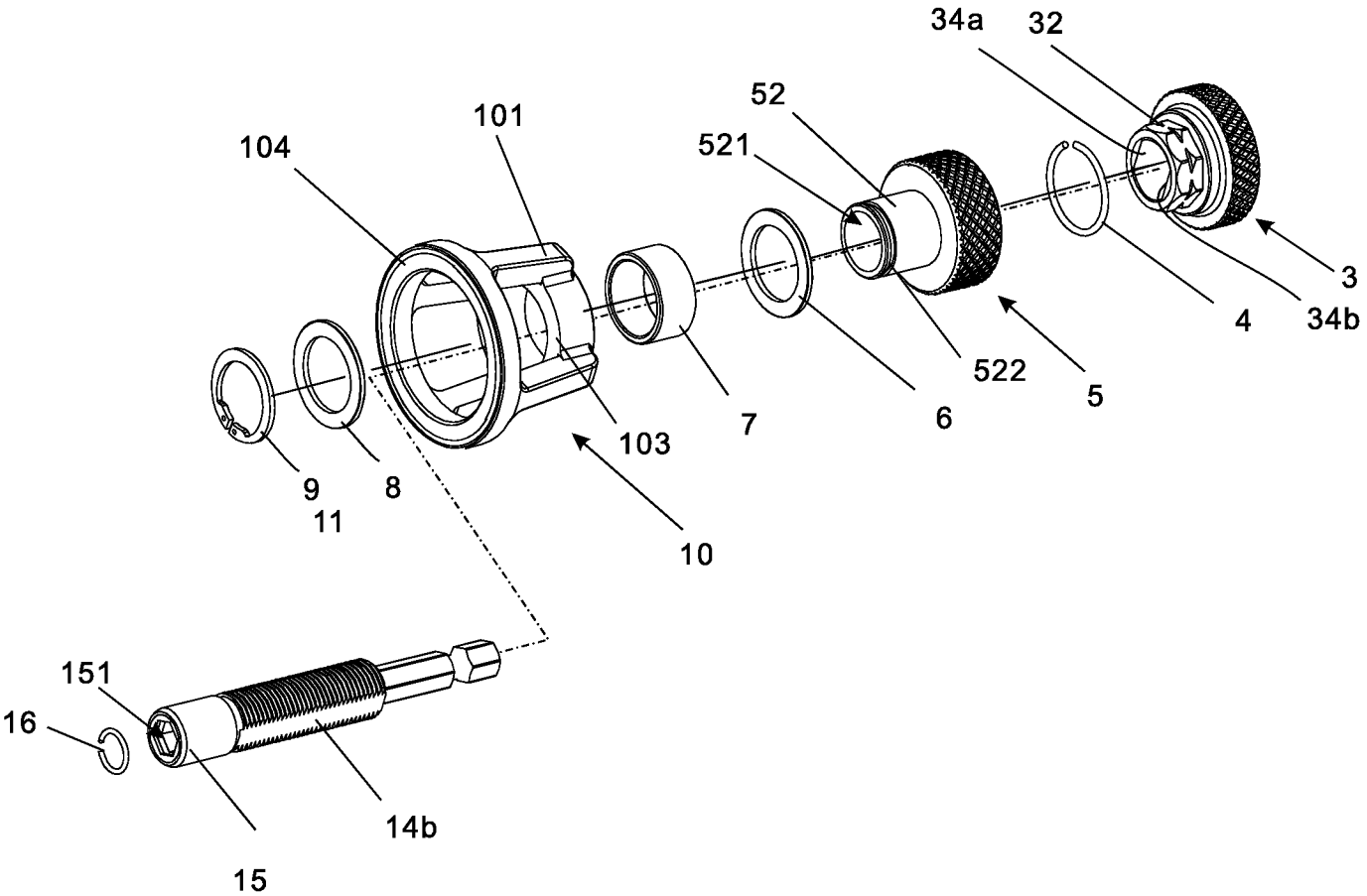
FIG. 2 is another explosive view of an embodiment viewed from another angle according to the present invention.
Figure 3:
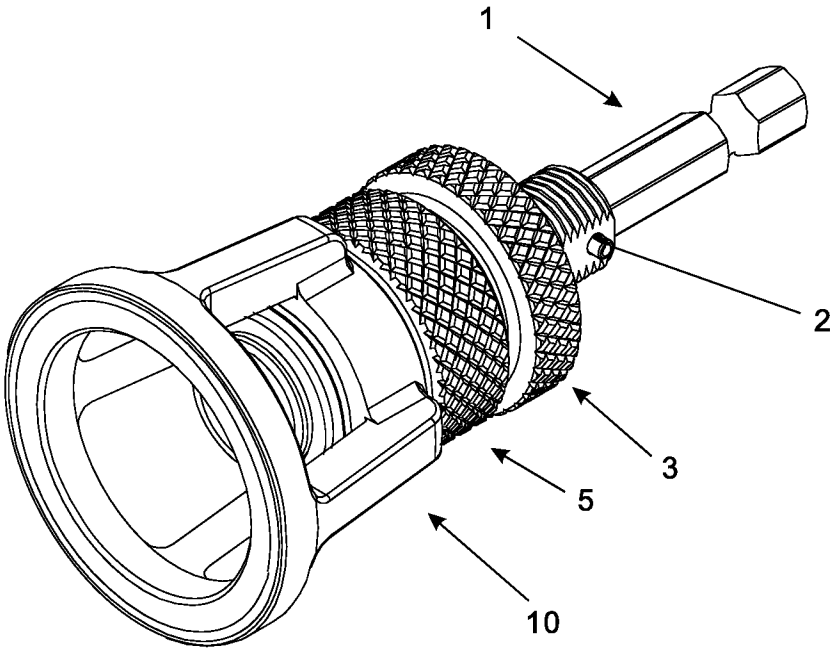
FIG. 3 is an assembly view of an embodiment according to the present invention.

Refer to FIG. 1, FIG. 2 and FIG. 3, a screw depth adjuster according to the present invention includes a rod 1, a control member 3, a driving member 5, a first washer 6, a flared sleeve 10, a second washer 8 and a fixing member 9, which are fitted on the rod 1 in turn. The rod 1 consists of a first portion 1*a* and a second portion 1*b* formed by extension of the first portion 1*a*. The first portion 1*a* is a polygonal rod 11 used for connection with power tools. The second portion 1*b* is a threaded rod 13 with an assembly portion 15 extended from the rear end of the threaded rod 13. The assembly portion 15 is provided with a slot 151 and a first C-shaped ring 16 is mounted in the slot 151. A first plane 14*a* and a second plane 14*b* are disposed on two sides of the threaded rod 13 longitudinally and arranged parallel to each other. A hole 12 is formed on both the first plane 14*a* and the second plane 14*b* at the position close to the first portion 1*a* while a stopping pin 2 is mounted in the hole 12.

The control member 3 is composed of a push portion 31, a polygonal stopper 32 extended from the push portion 31, a first passage 33 extended from the push portion 31 to the polygonal stopper 32, a third plane 34*a* and a fourth plane 34*b*. The cross section of the polygonal stopper 32 is a polygon. The third plane 34*a* and the fourth plane 34*b* are arranged in parallel and formed in the first passage 33 at the positions corresponding to the first plane 14*a* and the second plane 14*b* of the threaded rod 13. Thereby the control member 3 is able to be pushed and moved slidably axially on the threaded rod 13. The driving member 5 consists of an adjustment portion 51 and a sleeve portion 52 extended from the adjustment portion 51. A polygonal second passage 511 is disposed on the adjustment portion 51 and a circular limiting groove 512 is arranged at the second passage 511 while a second C-shaped ring 4 is mounted in the circular limiting groove 512. A third passage 521 is formed by extension of the second passage 511 from the intersection between the second passage 511 and the sleeve portion 52 to the sleeve portion 52. The third passage 521 is composed of a threaded segment and a smooth segment extended from the threaded segment. A circular groove 522 is formed on the sleeve portion 52. The shape of the polygonal second passage 511 of the adjustment portion 51 matches the shape of the polygonal stopper 32 of the control member 3. The cross section of the polygonal second passage 511 is also polygonal, the same as that of the polygonal stopper 32.

A fourth passage 101 is arranged at the flared sleeve 10 and a socket 7 is mounted in the fourth passage 101. The fourth passage 101 includes a first surface 102 and a second surface 103. The first washer 6 is abutting against the first surface 102 while the second washer 8 is abutting against the second surface 103. The flared sleeve 10 is a shade with windows and a contact surface 104 is formed on the bottom of the shade.

While being assembled, the sleeve portion 52 of the driving member 5 is first inserted through the first washer 6 and the socket 7. Then the socket 7 is inserted through the fourth passage 101 of the flared sleeve 10 and mounted into the second washer 8 correspondingly. The first portion 1*a* of the rod 1 is inserted into the third passage 521 and the second portion 1*b* reaches the threaded segment. The second portion 1*b* of the rod 1 is threaded through the threaded segment and continuingly until the assembly portion 15 is driven into the smooth segment of the third passage 521 of the driving member 5 and a part of the assembly portion 15 is exposed outside the sleeve portion 52 of the driving member 5. Next the fixing member 9 is mounted into the circular groove 522 of the sleeve portion 52. Then the control member 3 is pushed forward after the third plane 34*a* and the fourth plane 34*b* in the first passage 33 of the control member 3 being aligned with the first plane 14*a* and the second plane 14*b* of the threaded rod 13. Lastly the stopping pin 2 is inserted into the hole 12. The assembly process has been completed.

Figure 4:
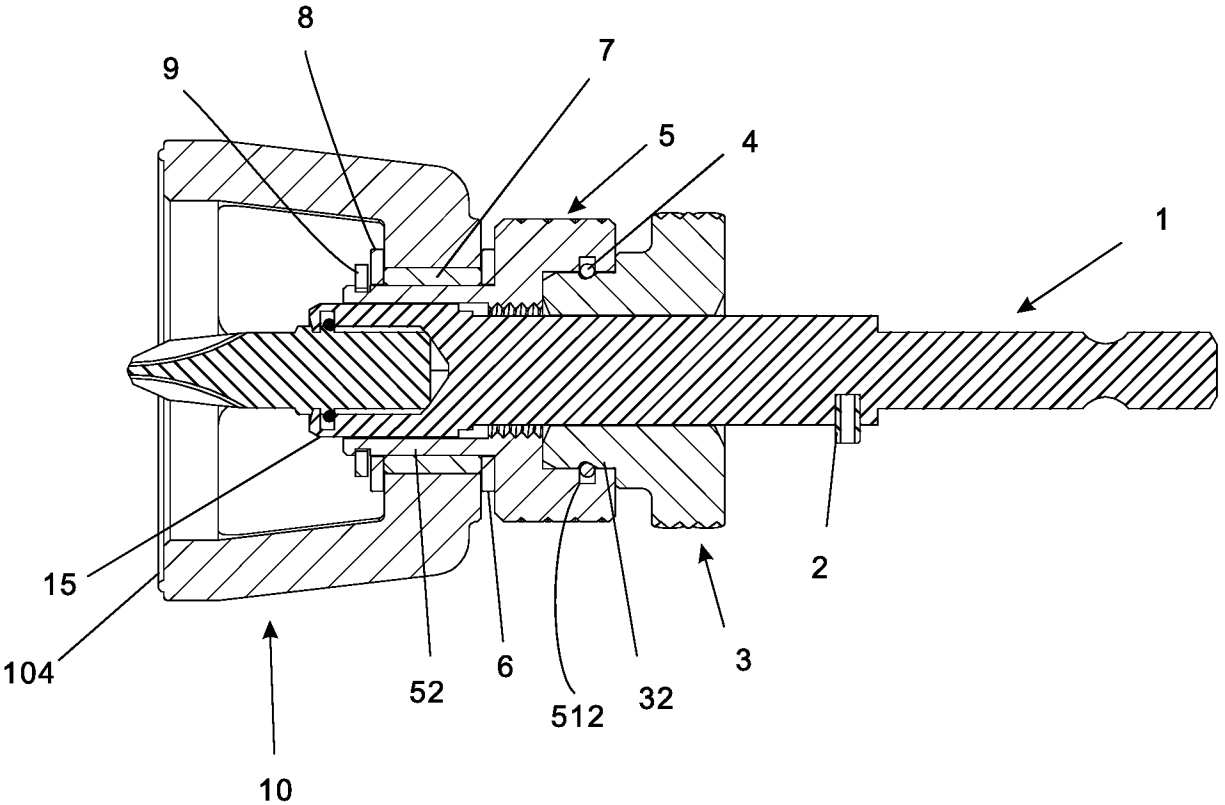
FIG. 4 is a side sectional view of an embodiment according to the present invention.

As shown in FIG. 3 and FIG. 4, the driving member 5 is mounted into the socket 7 after the socket 7 being mounted into the fourth passage 101 of the flared sleeve 10. The flared sleeve 10 is able to be rotated on the assembly portion 15. The flared sleeve 10 can be rotated more smoothly due to the first washer 6 and the second washer 8.

Moreover, the flared sleeve 10 can be pushed by the driving member 5 to be moved on the threaded rod 13. The polygonal stopper 32 of the control member 3 is used to be mounted into the polygonal second passage 511 of the adjustment portion 51 correspondingly and the second C-shaped ring 4 is used to temporarily hold and position the control member 3 for preventing the control member 3 from being released. At the moment, the driving member 5 is locked by the control member 3 and unable to be rotated and moved on the threaded rod 13. As to the driving member 5, it is used to push the flared sleeve 10 so that the flared sleeve 10 is able to be moved and positioned at any position of the threaded rod 13 for adjustment of the depth of the screw. Thereby the flared sleeve 10 can be moved forward or backward on the threaded rod 13 under control of the longitudinal movement of the diving member 5 which is determined according to the depth of the screw required by users. Thereby the screw will not be driven beyond the depth required in the workpiece and dents formed on the surface of the workpiece can be minimized.

During the driving operation, a method for driving a screw to a depth required steadily according to the present invention includes the following steps. First rotate the driving member 5 on the threaded rod 13 to move to the positioned required. Now the flared sleeve 10 is pushed by the driving member 5 to move forward or backward on the threaded rod 13 synchronously. Then the control member 3 is pushed and inserted into the second passage 511 of the driving member 5 until the polygonal stopper 32 being mounted into the polygonal second passage 511. Thereby the driving member 5 is locked by the control member 3, unable to be moved and rotated.

Figure 5:
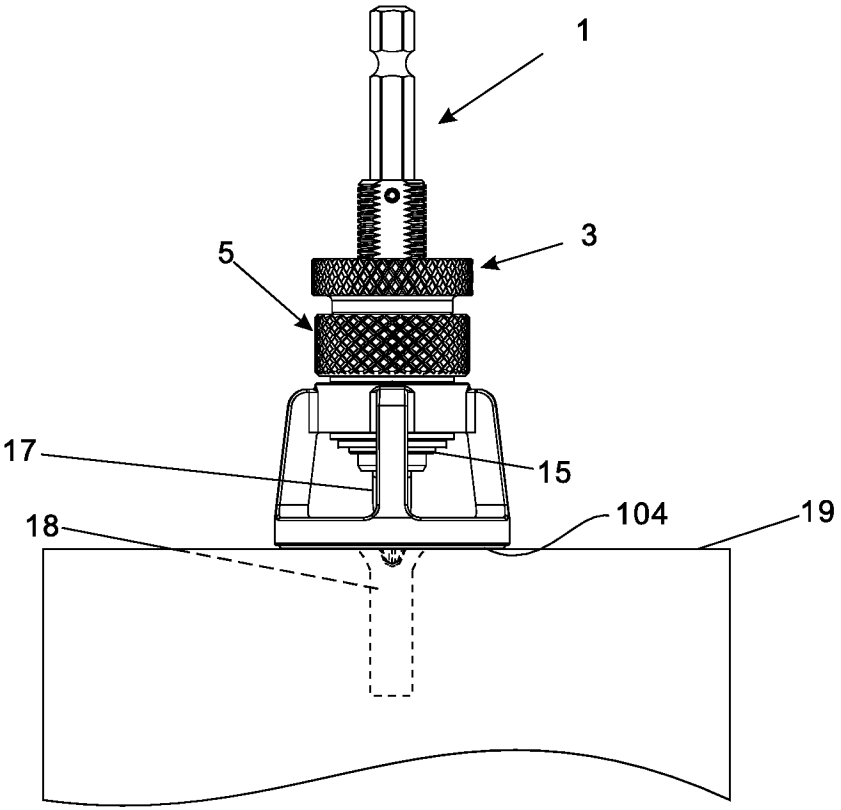
FIG. 5 is a perspective view of an embodiment while in use according to the present invention.

As shown in FIG. 4, while in use, first a head of a screwdriver bit 17 is placed into assembly portion 15 of the driving member 5 to be mounted and positioned therein. At the moment, the working end of the screwdriver bit 17 is exposed outside the contact surface 104 of the flared sleeve 10. When the user rotates the driving member 5, the flared sleeve 10 is synchronously driven to move longitudinally. The user can directly see the length of the working end of the screwdriver bit 17 protruding from the contact surface 104 of the flared sleeve 10. After finding the length between the working end of the screwdriver bit 17 and the contact surface 104, the control member 3 is pushed and inserted into the second passage 511 of the driving member 5 until the polygonal stopper 32 is mounted into the second passage 511 so that the driving member 5 is locked and unable to be rotated and moved. Now the first portion 1*a* of the rod 1 is connected to a power tool while a screw 18 is fitted on the working end of the screwdriver bit 17. Once the present invention is driven by the power tool to rotate until the contact surface 104 of the flared sleeve 10 is abutting against the surface of the workpiece/material 19, the flared sleeve 10 is idling and unable to drive the screw 18, as shown in FIG. 5.

In summary, the present invention has the following advantages:

1. The user can see the length of the working end of the screwdriver bit 17 protruding from the contact surface 104 of the flared sleeve 1 in a real time manner while operating the driving member 5 so that the screw depth can be adjusted all at once.

2. The present device provides fine adjustment of the screw depth due to that the shape of the polygonal second passage 511 of the adjustment portion 51 matches the shape of the polygonal stopper 32 of the control member 3. When the driving member is rotated to a required position which is corresponding to one side of the polygonal cross section of the polygonal stopper 32. Each side of the polygonal cross section represents a scale of fine adjustment. There are at least four sides of the polygonal cross section. The polygon can be a hexagon, an octagon, a dodecagon, a star polygon or a circle with a zig zag border. Take the octagon as an example. Compared with the device available now, the present invention provides fine adjustment of the screw depth. In the device available now, the device needs to be rotated at least half a circle as one scale for adjustment of the depth. It is assumed that the depth being adjusted is 1 mm when the device available now is rotated a circle. Thus one scale (being rotated half a circle) is 1 mm/2. That's 0.5 mm. Owing to the octagon of the present invention, one scale is 1 mm/8. In the present invention, the minimum depth able to be adjusted is 1 mm/8. That's 0.125 mm. Thus the polygonal shape of the present invention provides the fine adjustment function.

3. The first passage 33 of the control member 3 are provided with the third plane 34*a* and the fourth plane 34*b* which are arranged parallel to each other and aligned with the first plane 14*a* and the second plane 14*b* of the threaded rod 13 respectively. Thereby the control member 3 is able to be moved slidably on the threaded rod 13. Owing to the parallel design of the planes 34*a*, 34*b*, the impact force acted on the first passage 33 of the control member 3 can be dispersed and the control member 3 will not be deformed.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A screw depth adjuster used for driving screws to a certain depth during driving process, comprising:

a rod having a first portion which is a polygonal rod used for connection with power tools; and a second portion, which is a threaded rod formed by extension of the first portion, having an assembly portion extended from a rear end of the threaded rod, a first plane and a second plane, wherein the first plane and the second plane are disposed on two sides of the threaded rod longitudinally and arranged parallel to each other, and a hole located close to the first portion, and comprising a stopping pin assembled in the hole and a first C-shaped ring mounted in a slot of the assembly portion; and a control member, a driving member, a first washer, a flared sleeve, a second washer, and a fixing member, which are fitted on the rod;

the control member having a push portion and comprising a polygonal stopper extended from the push portion, wherein the control member further has a first passage extended from the push portion to the polygonal stopper, a third plane and a fourth plane, wherein the third plane and the fourth plane are arranged in parallel and formed in the first passage at positions corresponding to the first plane and the second plane of the threaded rod so that the control member is able to be pushed and moved slidably and axially on the threaded rod;

wherein the driving member has an adjustment portion with a polygonal second passage and a sleeve portion extended from the adjustment portion, wherein a circular limiting groove is arranged at the polygonal second passage while a second C-shaped ring is mounted in the circular limiting groove, wherein a third passage, having a thread segment and a smooth segment, is formed by extension of the second passage from an intersection between the second passage and the sleeve portion, wherein a circular groove is formed on the sleeve portion and a shape of the polygonal second passage of the adjustment portion matches a shape of the polygonal stopper of the control member;

wherein a fourth passage, having a first surface and a second surface, is arranged at the flared sleeve while a socket is mounted in the fourth passage wherein the first washer is abutting against the first surface while the second washer is abutting against the second surface;

wherein the sleeve portion of the driving member is firstly inserted through the first washer and the socket, secondly the socket is inserted through the fourth passage of the flared sleeve and mounted into the second washer correspondingly wherein the rod is inserted into the third passage of the driving member, threaded through the threaded segment and continuingly threaded until the assembly portion is driven into the smooth segment of the third passage of the driving member and a part of the assembly portion is exposed outside the sleeve portion of the driving member, thirdly the fixing member is mounted into the circular groove of the sleeve portion, fourthly the control member is pushed forward after the third plane and the fourth plane in the first passage of the control member are aligned with the first plane and the second plane of the threaded rod, and lastly the stopping pin is inserted into the hole of the first portion to complete assembling.

2. A screw depth adjuster used for driving screws to a certain depth during driving process, comprising:

a rod having a first portion used for connection with power tools; and a second portion, which is a threaded rod formed by extension of the first portion, having an assembly portion extended from a rear end of the threaded rod, a first plane and a second plane, wherein the first plane and the second plane are disposed on two sides of the threaded rod longitudinally and arranged parallel to each other;

a control member, having a push portion, a first passage, a first plane and a fourth plane, including:

a polygonal stopper extended from the push portion, wherein the first passage is extended from the push portion to the polygonal stopper, wherein the third plane and the fourth plane are arranged in parallel and formed in the first passage at positions corresponding to the first plane and the second plane of the threaded rod;

a driving member having:

an adjustment portion provided with a polygonal second passage having a shape corresponding to a shape of the polygonal stopper of the control member, and a sleeve portion being formed by extension of the adjustment portion and having a third passage which has a threaded segment and a smooth segment and is formed by extension of the second passage from an intersection between the second passage and the sleeve portion and a circular groove;

a flared sleeve provided with a fourth passage which has a first surface and a second surface;

a socket mounted in the fourth passage;

a first washer which is abutting against the first surface;

a second washer which is abutting against the second surface; and a fixing member;

wherein the control member is able to be pushed and moved slidably and axially on the threaded rod by the third plane and the fourth plane in the first passage of the control member being is aligned with and fitted on the first plane and the second plane of the threaded rod;

wherein the rod is inserted into and threaded through the third passage continuingly until a part of the assembly portion is exposed outside the sleeve portion of the driving member;

wherein after the socket being mounted in the fourth passage of the flared sleeve, the sleeve portion of the driving member is firstly inserted through the first washer and the socket to be mounted into the second washer correspondingly, and the fixing member is lastly mounted into the circular groove of the sleeve portion.

* * * * *